US007122767B2

(12) United States Patent
Sato et al.

(10) Patent No.: US 7,122,767 B2
(45) Date of Patent: Oct. 17, 2006

(54) METHOD FOR CONTROLLING POWER SUPPLY TO FIXING ROLLER IN IMAGE FORMING APPARATUS

(75) Inventors: Naoki Sato, Kanagawa (JP); Keiichi Sugai, Miyagi (JP); Masae Sugawara, Miyagi (JP); Masashi Ooi, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/048,793

(22) Filed: Feb. 3, 2005

(65) Prior Publication Data

US 2005/0167420 A1 Aug. 4, 2005

(30) Foreign Application Priority Data

Feb. 3, 2004 (JP) ..... 2004-026681
Feb. 5, 2004 (JP) ..... 2004-029645

(51) Int. Cl.
*H05B 1/02* (2006.01)

(52) U.S. Cl. ..... 219/497; 219/508; 219/216; 399/69

(58) Field of Classification Search ..... 219/497, 219/494, 492, 501, 506, 216, 508, 212, 483–486; 358/1.15; 399/69
See application file for complete search history.

(56) References Cited

U.S. PATENT DOCUMENTS 4,723,835 A * 2/1988 Franklin ..... 349/61
4,740,671 A * 4/1988 Kuroda et al. ..... 219/492
5,350,900 A * 9/1994 Inage et al. ..... 219/508
5,420,396 A * 5/1995 Itoh et al. ..... 219/497
6,222,158 B1 * 4/2001 Nakata et al. ..... 219/216
2004/0245236 A1 * 12/2004 Cook et al. ..... 219/216
2005/0057770 A1 * 3/2005 Taylor et al. ..... 358/1.15

FOREIGN PATENT DOCUMENTS

JP 2002-184554 6/2002
JP 2003-295659 10/2003
JP 2003-297526 10/2003
JP 2003295659 A * 10/2003

* cited by examiner

*Primary Examiner*—Mark Paschall
(74) *Attorney, Agent, or Firm*—Oblon, Spivak, McClelland, Maier & Neustadt, P.C.

(57) ABSTRACT

A fixing roller in an image forming apparatus (such as a copier) has a fixing heater that is supplied power from a capacitor. The fixing heater, the capacitor, a mechanical switch (such as a relay) and a semiconductor switch (such as a FET) are serially connected. As a cover of the apparatus is opened, an interlock switch is turned on and outputs an off-signal to a CPU, which turns off the semiconductor switch prior to turning off the mechanical switch, and thereby prevents a counter-electromotive voltage due to an inrush current.

11 Claims, 8 Drawing Sheets

METHOD FOR CONTROLLING POWER SUPPLY TO FIXING ROLLER IN IMAGE FORMING APPARATUS

CROSS-REFERENCE TO RELATED APPLICATIONS

The present document incorporates by reference the entire contents of Japanese priority documents, 2004-026681 filed in Japan on Feb. 3, 2004 and 2004-029645 filed in Japan Feb. 5, 2004.

BACKGROUND OF THE INVENTION

1) Field of the Invention

The present invention relates to a method for controlling power supply to prevent counter-electromotive voltage due to an inrush current passing through a fixing heater embedded in a fixing roller of an image forming apparatus, such as a digital copying machine.

2) Description of the Related Art

Japanese Patent Application Laid Open (JP-A) No. 2002-184554, JP-A No. 2003-295659, and JP-A No. 2003-297526 disclose technology for a heating element (fixing heater) of a fixing device used in an electrophotographic image forming apparatus. This technology is such that in addition to a power supply from a commercial power supply, a chargeable auxiliary power supply using an electric double layer capacitor is used to allow fast rising of temperature and thereby enhance effects of power saving.

In the conventional technology, however, if power is supplied from a capacitor to the heating element when the heating element is not heated, a large inrush current passes through the heating element, and counter-electromotive force may occur caused by an inductance component of the heating element. A circuit may be broken by voltage breakdown. To solve such inconvenience, it is desirable to use both a semiconductor switch and a mechanical switch as a switching element for controlling on/off of discharging from the capacitor to the heating element.

SUMMARY OF THE INVENTION

It is an object of the present invention to solve at least the problems in the conventional technology.

A fixing device according to an aspect of the present invention fixes a toner image to a recording medium by applying heat and pressure, and includes a heating unit that generates the heat; a capacitor that supplies power to the heating unit; and a switching unit, which includes a mechanical switch and a semiconductor switch, that causes the capacitor to supply the power to the heating unit.

An image forming apparatus according to another aspect of the present invention uses electrophotographic method to fix a toner image to a recording medium by applying heat and pressure, and includes a heating unit that generates the heat; a capacitor that supplies power to the heating unit; and a switching unit, which includes a mechanical switch and a semiconductor switch, that causes the capacitor to supply the power to the heating unit.

A heating device according to still another aspect of the present invention includes a heating unit that generates heat; a capacitor that supplies power to the heating unit; a switch that causes the capacitor to supply the power to the heating unit; and a power controlling unit that turns off the switch and keeps the switch turned on for a time required to prevent a counter-electromotive voltage due to an inrush current.

A fixing device according to still another aspect of the present invention fixes a toner image to a recording medium by applying heat and pressure, and includes a heating unit that generates the heat; a capacitor that supplies power to the heating unit; a switch that causes the capacitor to supply the power to the heating unit; and a power controlling unit that turns off the switch and keeps the switch turned on for a time required to prevent a counter-electromotive voltage due to an inrush current.

An image forming apparatus according to still another aspect of the present invention uses electrophotographic method to fix a toner image to a recording medium by applying heat and pressure, and includes a heating unit that generates the heat; a capacitor that supplies power to the heating unit; a switch that causes the capacitor to supply the power to the heating unit; and a power controlling unit that turns off the switch and keeps the switch turned on for a time required to prevent a counter-electromotive voltage due to an inrush current.

The other objects, features, and advantages of the present invention are specifically set forth in or will become apparent from the following detailed description of the invention when read in conjunction with the accompanying drawings.

DETAILED DESCRIPTION

Exemplary embodiments of a heating device, a fixing device, and an image forming apparatus according to the present invention are explained in detail below with reference to the accompanying drawings.

Figure 1:
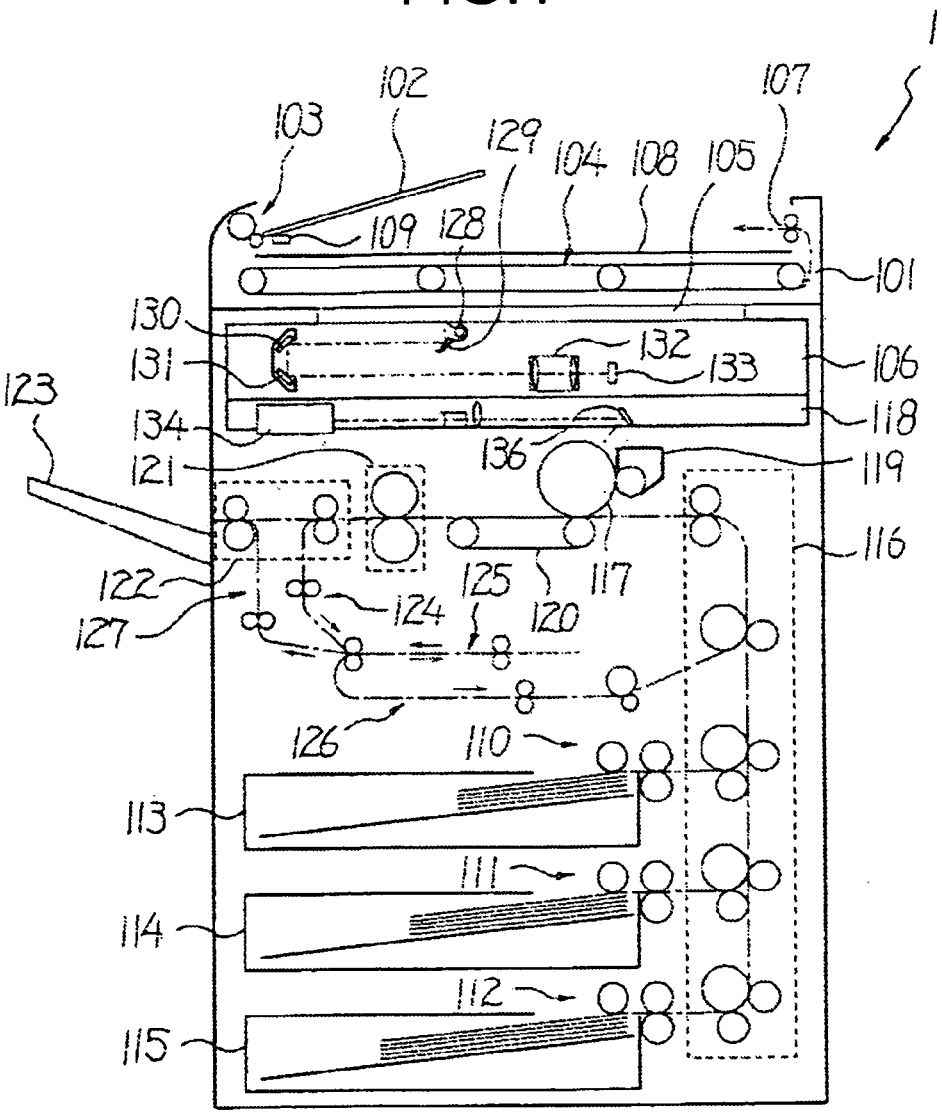
FIG. 1 is a vertical cross section of a digital copying machine according to the present invention.

FIG. 1 is a vertical cross section of a digital copying machine 1 (hereinafter, "copying machine 1") according to a first embodiment of the present invention. The copying machine 1 realizes the image forming apparatus according to the present invention, which is a multifunction peripheral. More specifically, the copying machine 1 includes a copying function and other functions such as a printer function and a facsimile function. The copying function, the printer function, and the facsimile function can be sequentially switched and selected through an operation of an application switch key provided in an operation unit (not shown). Based on the configuration, a mode is switched to a copying mode when the copying function is selected, it is switched to a print mode when the printer function is selected, and it is switched to a facsimile mode when the facsimile function is selected.

A schematic configuration of the copying machine 1 and an operation in the copying mode are explained below. As shown in FIG. 1, a document with the image face up is set on a document table 102 of an automatic document feeder (ADF) 101. When a start key in the operation unit (not shown) is pressed, the document is fed by a paper feed roller 103 and a paper feed belt 104 to a fixed position on the document table 102 including a contact glass 105. The ADF 101 has a count function of counting the number of documents each time feeding of a sheet of document is completed. The document on the contact glass 105 is read by an image reader 106 to obtain image data for the document, and the document is discharged onto a paper discharge base 108 by the paper feed belt 104 and a discharge roller 107.

If a document set detector 109 detects that the next document is present on the document table 102, the lowest document on the document table 102 is fed to the fixed position on the contact glass 105 by the paper feed roller 103 and the paper feed belt 104. The document on the contact glass 105 is read by the image reader 106 to obtain image formation for the document, and the document is discharged onto the paper discharge base 108 by the paper feed belt 104 and the discharge roller 107. The paper feed roller 103, the paper feed belt 104, and the discharge roller 107 are driven by a conveying motor.

The image reader 106 includes a light source 128, mirrors 129 to 131, a lens 132, and a charge-coupled device (CCD) 133.

Any paper feed device selected from a first paper feed device 110, a second paper feed device 111, and a third paper feed device 112 feeds a transfer paper loaded thereon. The transfer paper is conveyed by a vertical conveying unit 116 up to a position where the transfer paper comes in contact with a photosensitive drum 117. The photosensitive drum 117 employs, for example, a photosensitive drum, and is made to rotate by a main motor (not shown).

The image data read from the document by the image reader 106 is subjected to predetermined image processing by an image processor (not shown), and is converted to optical information by a writing unit 118. The photosensitive drum 117 is uniformly charged by a charger (not shown), and the photosensitive drum 117 charged is exposed with the optical information from the writing unit 118 and an electrostatic latent image is formed thereon. The electrostatic latent image on the photosensitive drum 117 is developed by a developing device 119 to form a toner image. The writing unit 118, the photosensitive drum 117, the developing device 119, and other known peripheral devices (not shown) around the photosensitive drum 117 constitute a printer engine that forms an image on a medium such as a sheet of paper using an electrophotographic method. It is noted that the writing unit 118 includes a laser writing device 134 and a reflecting mirror 136.

A conveying belt 120 serves as a unit for paper conveyance and also as a unit for image transfer, and is applied with transfer bias from a power supply. The conveying belt 120 transfers a toner image on the photosensitive drum 117 to a transfer paper while conveying the transfer paper from the vertical conveying unit 116 at a speed equal to that of the photosensitive drum 117. A fixing device 121 fixes the toner image on the transfer paper, and a paper discharge unit 122 discharges the transfer paper onto a paper discharge tray 123. After the toner image is transferred, toner remaining on the photosensitive drum 117 is cleaned by a cleaning device (not shown).

The operation so far is performed when an image is copied on one side of the paper in an ordinary copying mode. If images are copied on both sides of the transfer paper in a double-sided copying mode, a transfer paper is fed from any one of paper feed trays 113 to 115, an image is formed on a first surface of the transfer paper in the above manner. The path for the transfer paper with the image is switched so that it is conveyed not to the paper discharge tray 123 but to a paper feeding path 124 for double-sided copying. The transfer paper is switched back to be turned upside down by a reversing unit 125, and is conveyed to a paper conveying unit 126 for double-sided copying.

The paper conveying unit 126 conveys the transfer paper to the vertical conveying unit 116, and the vertical conveying unit 116 further conveys the transfer paper to a position where the transfer paper comes in contact with the photosensitive drum 117. The toner image formed on the photosensitive drum 117 in the above manner is transferred to a second surface of the transfer paper, and the toner image is fixed on the transfer paper by the fixing device 121 to obtain a double-sided copied paper. The double-sided copied paper is discharged to the paper discharge tray 123 by the paper discharge unit 122.

If the transfer paper is to be reversely discharged, the reversing unit 125 switches back the transfer paper and reverses it. The transfer paper reversed is conveyed not to the paper conveying unit 126 but is conveyed to a reversely-discharged-paper conveying path 127, and is discharged to the paper discharge tray 123 by the paper discharge unit 122.

In the print mode, instead of the image data sent from the image processor, image data sent from an external device is input to the writing unit 118, and an image is formed on the transfer paper in the above manner.

In the facsimile mode, a facsimile transmitter/receiver (not shown) transmits image data from the image reader 106 to the other party and receives image data from the other party. The facsimile transmitter/receiver inputs the image data received to the writing unit 118 instead of the image data from the image processor, and an image is formed on the transfer paper in the above manner.

The copying machine 1 includes a large capacity tray (LCT) and a finisher (both of which are not shown), and an operation unit. The finisher performs sorting, punching, and stapling on sheets of paper copied. The operation unit has functions of setting a mode to read a document, a magnification of copying, a paper feed stage, and any post-process by the finisher, and displays the operations set thereon for an operator.

Figure 2:
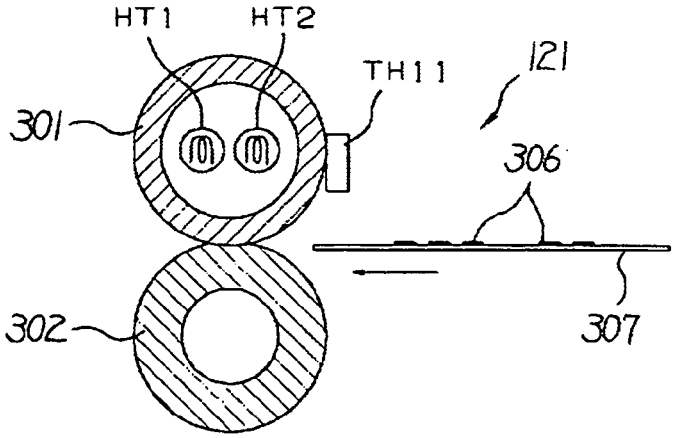
FIG. 2 is a diagram for explaining a fixing device in the digital copying machine.

The configuration of the fixing device 121 is explained below with reference to FIG. 2. The fixing device 121 realizes the heating device and the fixing device according to the present invention. The fixing device 121 includes a fixing roller 301 that is a target to be heated, and a pressing roller 302 that is formed of an elastic member such as silicone rubber and is pressed against the fixing roller 301 with a predetermined pressure force by a pressing unit (not shown). A fixing member and a pressing member are generally formed as a roller, but either one or both of the members may be formed with an endless belt. A fixing heater HT1 and a fixing heater HT2 are provided in arbitrary locations of the fixing device 121. For example, the fixing heaters HT1 and HT2 are arranged inside the fixing roller 301, and the fixing roller 301 is heated from the inside of the fixing roller 301.

A drive mechanism (not shown) rotates the fixing roller 301 and the pressing roller 302. A temperature sensor (e.g. thermistor) TH11 is made in contact with the surface of the fixing roller 301 to detect a temperature (fixing temperature) of the surface of the fixing roller 301. A sheet 307 is a medium such as a transfer paper that carries a toner image 306. When the sheet 307 passes through a nip part between the fixing roller 301 and the pressing roller 302, the toner image 306 is heated and pressed by the fixing roller 301 and the pressing roller 302 to be fixed on the sheet 307.

The fixing heater HT1 as a first heating member is a main heater that is turned on when the temperature of the fixing roller 301 does not reach a predetermined target temperature Tt as a reference, and heats the fixing roller 301. The fixing heater HT2 as a second heating member is an auxiliary heater that is turned on when a main power to the copying machine 1 is turned on or during a rising period from returning from a power saving mode explained later to being ready for copying. In other words, the fixing heater HT2 is turned on when the fixing device 121 is warmed up, and heats the fixing roller 301.

Figure 3:
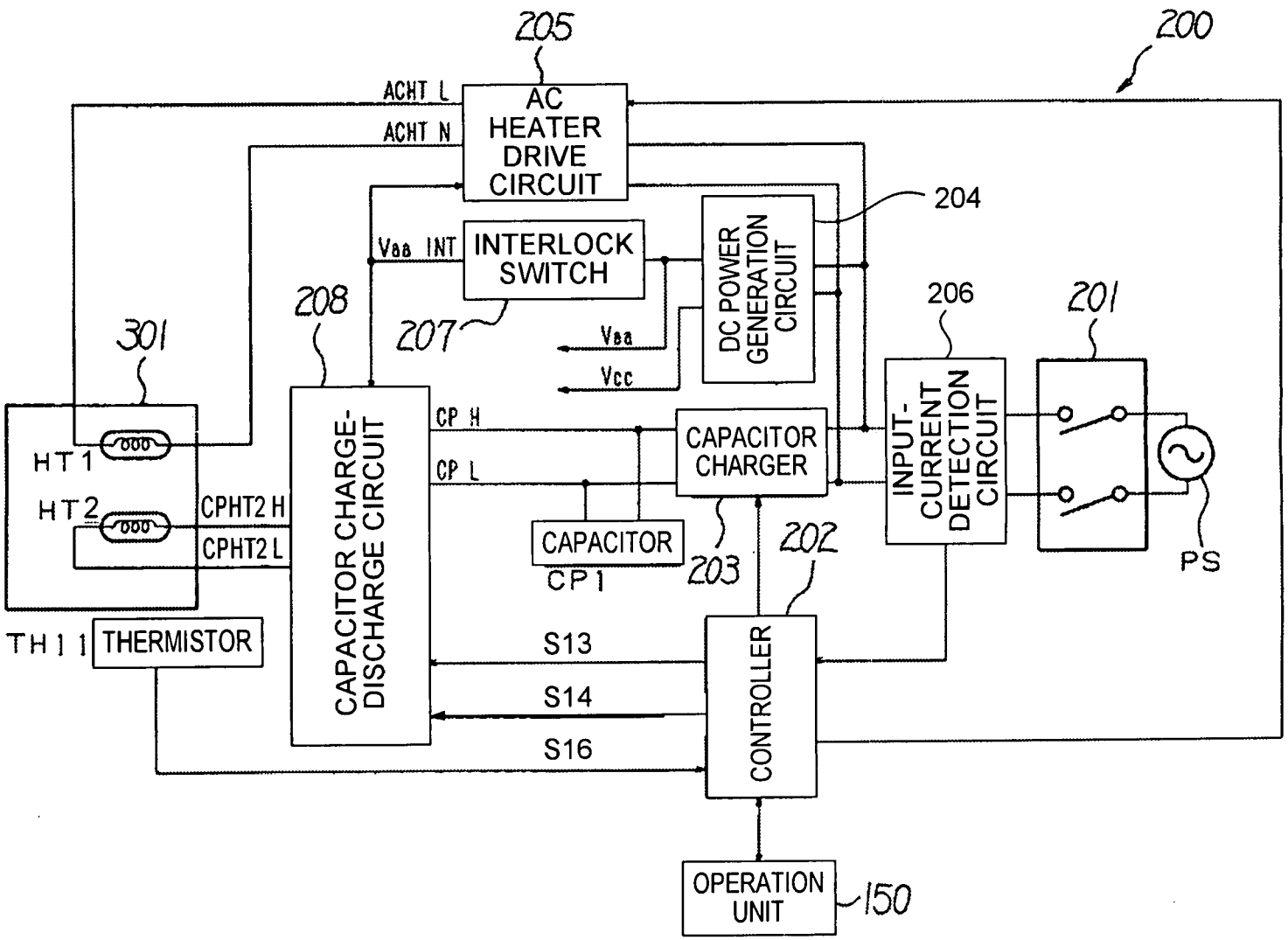
FIG. 3 is a circuit diagram of a power control system of the fixing device.

FIG. 3 is a circuit diagram of a power control system of the fixing device 121 in the copying machine 1. The power control system includes a main power supply SW 201 that switches an alternating-current (AC) power supply (commercial AC power supply) PS; a controller 202 that includes a microcomputer and controls components of a power supply circuit 200 and other parts; a capacitor CP1 that is an auxiliary power supply for the fixing heater HT2; and a capacitor charger 203 that charges the capacitor CP1; a direct-current (DC) power generation circuit 204 that generates DC power for the copying machine 1; an AC-heater drive circuit 205 that supplies AC power to the fixing heater HT1; an input-current detection circuit 206 that detects an input current from the AC power supply PS; an interlock switch 207; and a capacitor charge-discharge circuit 208 that supplies DC power to the fixing heater HT2 by causing the capacitor CP1 to discharge.

The AC power supply PS supplies AC power to the AC-heater drive circuit 205, the DC-power generation circuit 204, and the capacitor charger 203 through the main power supply SW 201 and the input-current detection circuit 206.

The controller 202 controls mainly the components of the power supply circuit 200, and controls the operations of the capacitor charger 203, the AC-heater drive circuit 205, and the capacitor charge-discharge circuit 208. More specifically, the controller 202 outputs a control signal S11 to the capacitor charger 203 so as to control a charging operation to the capacitor CP1 by the capacitor charger 203. The controller 202 outputs a control signal S13 and a control signal S14 to the capacitor charge-discharge circuit 208 so as to control an on/off operation of the fixing heater HT2 by the capacitor charge-discharge circuit 208. The controller 202 also outputs a control signal to the AC-heater drive circuit 205 to control an on/off operation of the fixing heater HT1 by the AC-heater drive circuit 205.

The input-current detection circuit 206 is provided between the main power supply SW 201, the AC-heater drive circuit 205, the DC-power generation circuit 204, and the capacitor charger 203. The input-current detection circuit 206 detects an input current from the AC power supply PS through the main power supply SW 201, and outputs a signal indicating the current detected to the controller 202. The input current fluctuates according to each operating status of the AC-heater drive circuit 205, the DC-power generation circuit 204, the capacitor charger 203, and the image forming apparatus.

The DC-power generation circuit 204 generates power Vcc and power Vaa based on the AC power input through the main power supply SW 201, and outputs the power Vcc and the power Vaa to the components. The power Vcc is used mainly for the control system of the image forming apparatus, and the power Vaa is used mainly for the drive system and high- and medium-voltage power supply.

The interlock switch 207 is a switch that is turned on and off in conjunction with opening and closing of a cover (not shown) provided in the housing of the copying machine 1. Details thereof are explained later.

The capacitor charger 203 is connected to the capacitor CP1, and charges the capacitor CP1 based on the control signal S11 input from the controller 202.

The capacitor CP1 is formed with a capacitor having large capacity such as the electric double layer capacitor. The capacitor CP1 is connected to the capacitor charger 203 and the capacitor charge-discharge circuit 208. The capacitor CP1 is charged by the capacitor charger 203 and the power charged is supplied to the fixing heater HT2 under the on/off control of the capacitor charge-discharge circuit 208.

The capacitor charge-discharge circuit 208 discharges the power accumulated in the capacitor CP1 according to the control signals S13 and S14 input from the controller 202, and turns on/off the fixing heater HT2.

The thermistor TH11 is provided near the fixing roller 301, and outputs a detection signal S16 indicating the surface temperature of the fixing roller 301 to the controller 202. Since the resistance of the thermistor TH11 changes depending on temperature (more specifically, the resistance decreases with an increase in temperature), the controller 202 detects the surface temperature of the fixing roller 301 using the phenomenon of changes in the resistance due to the temperature.

A first example of the configurations and operations of the capacitor charge-discharge circuit 208 and the controller 202 according to the first embodiment of the present invention is explained below.

Figure 4:
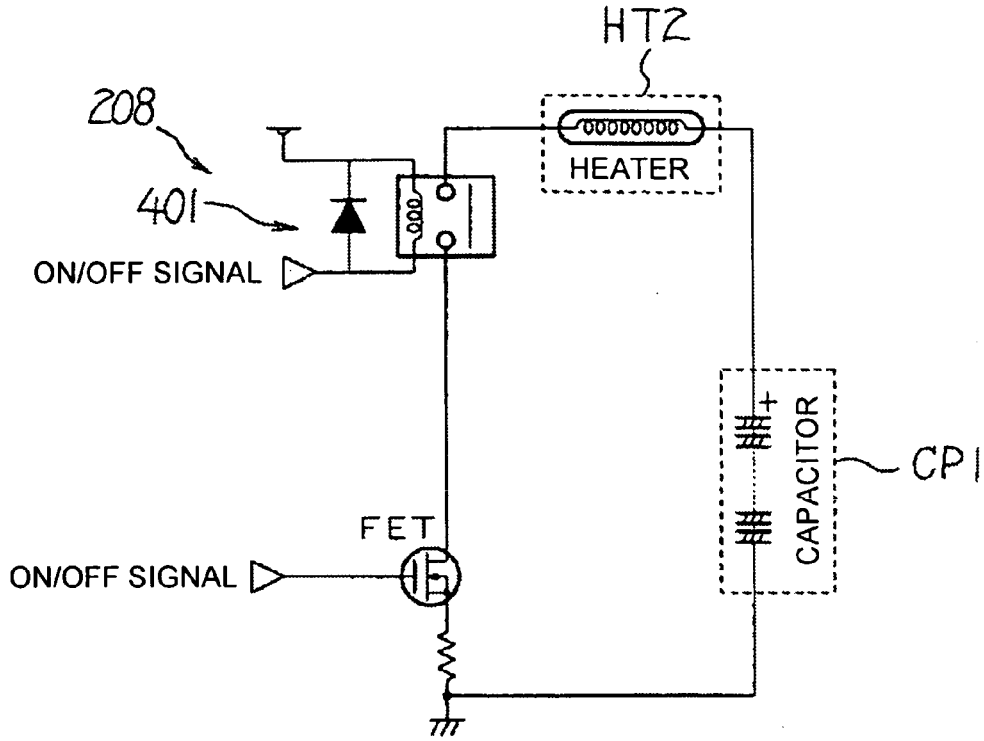
FIG. 4 is a circuit diagram for explaining a first example according to a first embodiment of the present invention.

As shown in FIG. 4, the capacitor charge-discharge circuit 208 includes a relay 401 as a mechanical switch, and a semiconductor switch FET that includes such as a metal oxide semiconductor field-effect transistor (MOSFET). The relay 401, the semiconductor switch FET, the capacitor CP1, and the fixing heater HT2 are serially connected, and the fixing heater HT2 is supplied power from the capacitor CP1 when the relay 401 and the semiconductor switch FET are turned on.

As explained above, turning on/off the power supply from the capacitor CP1 to the fixing heater HT2 is performed by using the relay 401 as well as the semiconductor switch FET, which allows improvement of the safety of the circuit.

Figure 5:
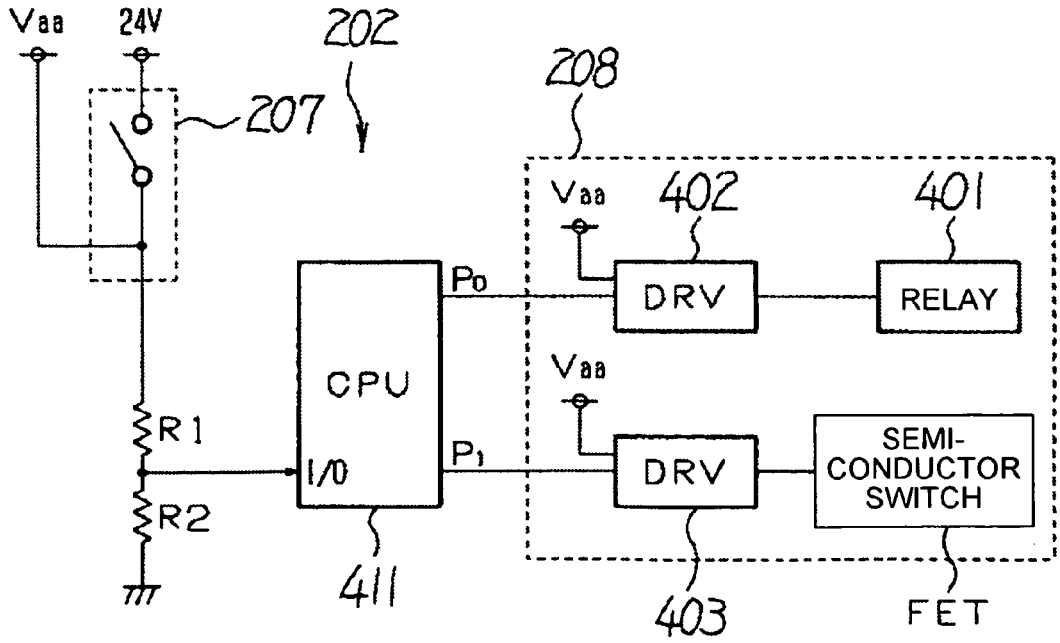
FIG. 5 is another circuit diagram for explaining the first example.

As shown in FIG. 5, the relay 401 is driven by a driver circuit 402 and the semiconductor switch FET is driven by a driver circuit 403. The driver circuits 402 and 403 are controlled by a microcomputer 411 of the controller 202. The interlock switch 207 is a switch that is opened and closed according to open/close of the cover (not shown) provided in the housing of the copying machine 1. When the cover is closed, the interlock switch 207 is closed, and the voltage of 24 volts is decreased by a resistor R1 and input into the microcomputer 411 as an on-signal (high level signal). When the cover is opened, the interlock switch 207 is also opened, and an input to the microcomputer 411 is changed to an off-signal (low level signal).

The control process executed by the microcomputer 411 based on the circuit configuration is explained below with reference to a timing chart of FIG. 6.

Figure 6:
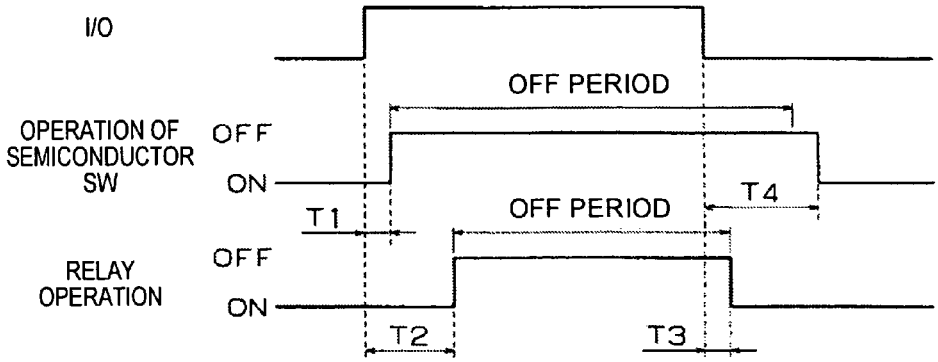
FIG. 6 is a timing chart for explaining status of each element shown in FIG. 5.

FIG. 6 is a timing chart for explaining status of an input-output (I/O) port of the microcomputer 411 according to the open/close of the interlock switch 207, the semiconductor switch FET, and the relay 401.

When the interlock switch 207 is opened, power supply (Vaa) to the driver circuits 402 and 403 shown in FIG. 5, which drive the relay 401 and the semiconductor switch FET respectively, is stopped. Even if the power supply to the driver circuits 402 and 403 are stopped simultaneously, the semiconductor switch FET is turned off earlier than the relay 401 as shown in FIG. 6, because the operation speed of the semiconductor switch FET is higher than that of the relay 401.

However, when the process of stopping the power supply is slow and the microcomputer 411 operates very fast, the above delay can be realized by software. More specifically, when detecting the on-signal on the I/O port (in other words, detecting that the interlock switch 207 has opened), the microcomputer 411 turns off a P1 port (the semiconductor switch FET connected to the P1 port), and then turns off a P0 port (the relay 401 connected to the P0 port), which allows prevention of contact welding and contact failure.

In FIG. 6, delay time T1/T2 means a time required for the relay 401 or the semiconductor switch FET to become off after the off-signal is input into the I/O port of the microcomputer 411. Delay time T3/T4 means a time required for the relay 401 or the semiconductor switch FET to become on after the on-signal is input into the I/O port of the microcomputer 411. A difference between delay times T1 and T2 is due to a difference between operation speeds of a mechanical switch and a semiconductor switch. On the other hand, a difference between delay times T3 and T4 is realized by the software that controls on/off of the relay 401 and the semiconductor switch FET, as well as the difference in the operation speeds of them.

As explained above, the open/close of the cover of the housing for the copying machine 1 is detected by the interlock switch 207, and when the cover is opened the power supply from the capacitor CP1 to the fixing heater HT2 is stopped to improve safety.

Figure 7:
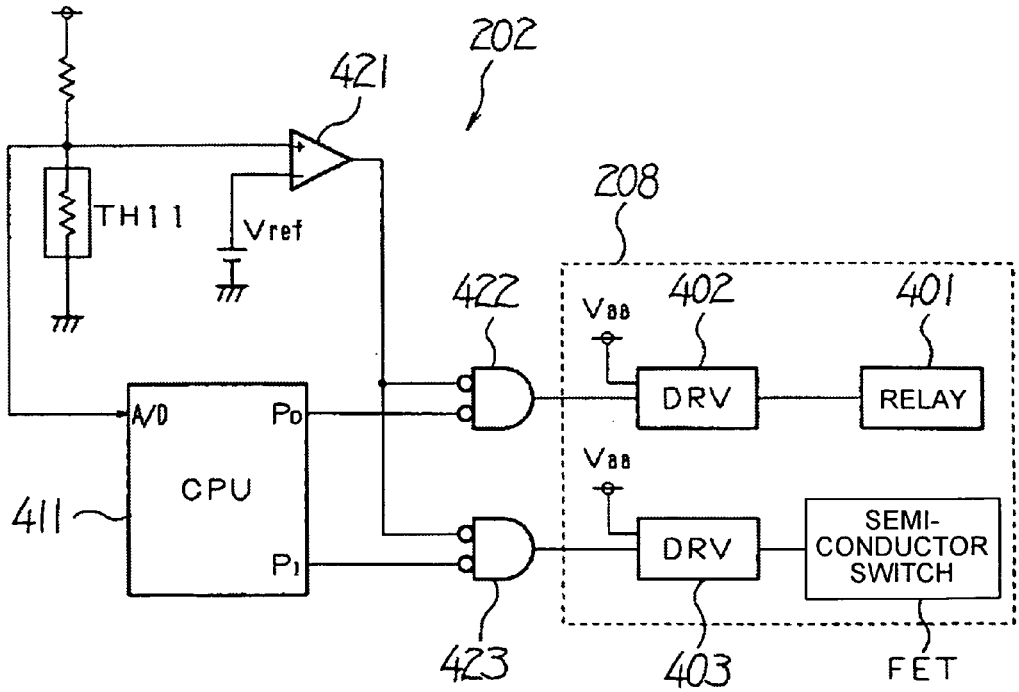
FIG. 7 is a circuit diagram for explaining a second example according to the first embodiment.

A second example according to the first embodiment of the present invention is explained below with reference to FIG. 7. In the configuration shown in FIG. 7, a comparator circuit 421, an AND circuit 422, and an AND circuit 423 are added to the configuration shown in FIG. 5 (the interlock switch 207 and the resistors R1 and R2 are omitted in FIG. 7).

The comparator circuit 421 compares an output value of the temperature sensor TH11 with a predetermined reference value Vref. When the output value of the temperature sensor TH11 is below the reference value Vref (in other words, the temperature of the fixing roller 301 exceeds an upper limit), the comparator circuit 421 outputs a off-signal (low level signal). The AND circuit 422 takes a logical product of an output of the P0 port of the microcomputer 411 and an output of the comparator circuit 421, and outputs the logical product to the driver circuit 402. The AND circuit 423 takes a logical product of an output of the P1 port the microcomputer 411 and the output of the comparator circuit 421, and outputs the logical product to the driver circuit 403.

The microcomputer 411 compares the output value of the temperature sensor TH11 with a predetermined reference value (which can be set slightly lower than the above-mentioned reference value Vref). When the output value is not below the reference value, the microcomputer 411 outputs an off-signal from the P1 port, and then from the P0 port. As a result, output of both the AND circuits 422 and 423 become non-active, and the driver circuits 402 and 403 stop their operations to stop the power supply from the capacitor CP1 to the fixing heater HT2. Thus, when the temperature of the fixing roller 301 becomes too high, the power supply to the fixing roller 301 is forcefully turned off to achieve the safety.

Even when runaway occurs in the microcomputer 411, the power supply to the fixing roller 301 is turned off, because when the temperature of the fixing roller 301 increases and the output value of the temperature sensor TH11 become below not the reference value Vref, the comparator circuit 421 outputs the off-signal to the AND circuits 422 and 423 to make the output thereof non-active and to make the driver circuits 402 and 403 stop their operations.

Figure 8:
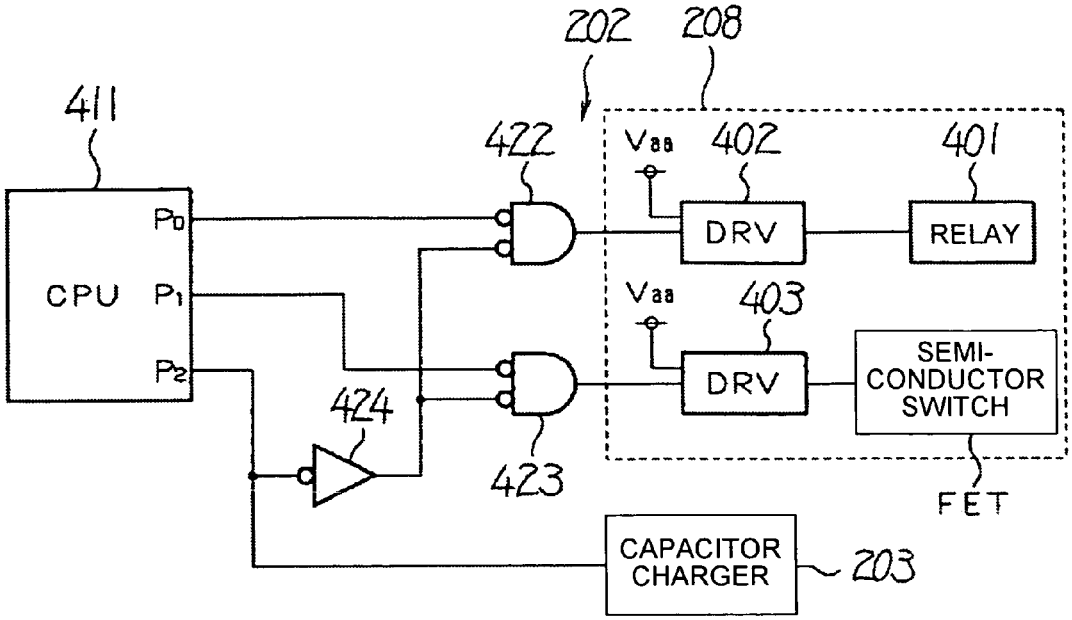
FIG. 8 is a circuit diagram for explaining a third example according to the first embodiment.

A third example according to the first embodiment of the present invention is explained below with reference to FIG. 8. In the configuration shown in FIG. 8, the AND circuits 422 and 423 and an inverter circuit 424 are added to the configuration shown in FIG. 5 (the interlock switch 207 and the resistors R1 and R2 are omitted in FIG. 8).

The microcomputer 411 outputs to the capacitor charger 203, a control signal P2 for controlling power supply from the capacitor charger 203 to the capacitor CP1. In this example, the capacitor charger 203 charges the capacitor CP1 when the control signal P2 from the microcomputer 411 is an on-signal (high level signal), and stops charging the capacitor CP1 when the control signal P2 is an off-signal (low level signal).

The inverter circuit 424 outputs a reverse signal of the control signal P2. The AND circuit 422 takes a logical product of the output of the P0 port and the output of the inverter circuit 424, while the AND circuit 423 takes a logical product of the output of the P1 port and the output of the inverter circuit 424.

While the capacitor charger 203 charges the capacitor CP1, the control signal P2 from the microcomputer 411, which is the on-signal, is converted into the off-signal at the inverter circuit 424, and input into the AND circuits 422 and 423. As a result, the output of the AND circuits 422 and 423 is always non-active, irrespective whether the output of the P0 port and the P1 port is the on-signal or the off-signal. In other words, the relay 401 and the semiconductor switch FET are always off during the charge of the capacitor CP1 by the capacitor charger 203, to prevent the power supply from the capacitor CP1 to the fixing heater HT2. Thus, the charge and discharge of the capacitor CP1 are not simultaneously conducted, resulting in safety of the circuits.

A digital copying machine according to a second embodiment of the present invention is explained below. The digital copying machine according to the second embodiment has basically the same configuration as that of the first embodiment as shown in FIG. 1 to FIG. 3, and therefore, only different portions are explained below.

Figure 9:
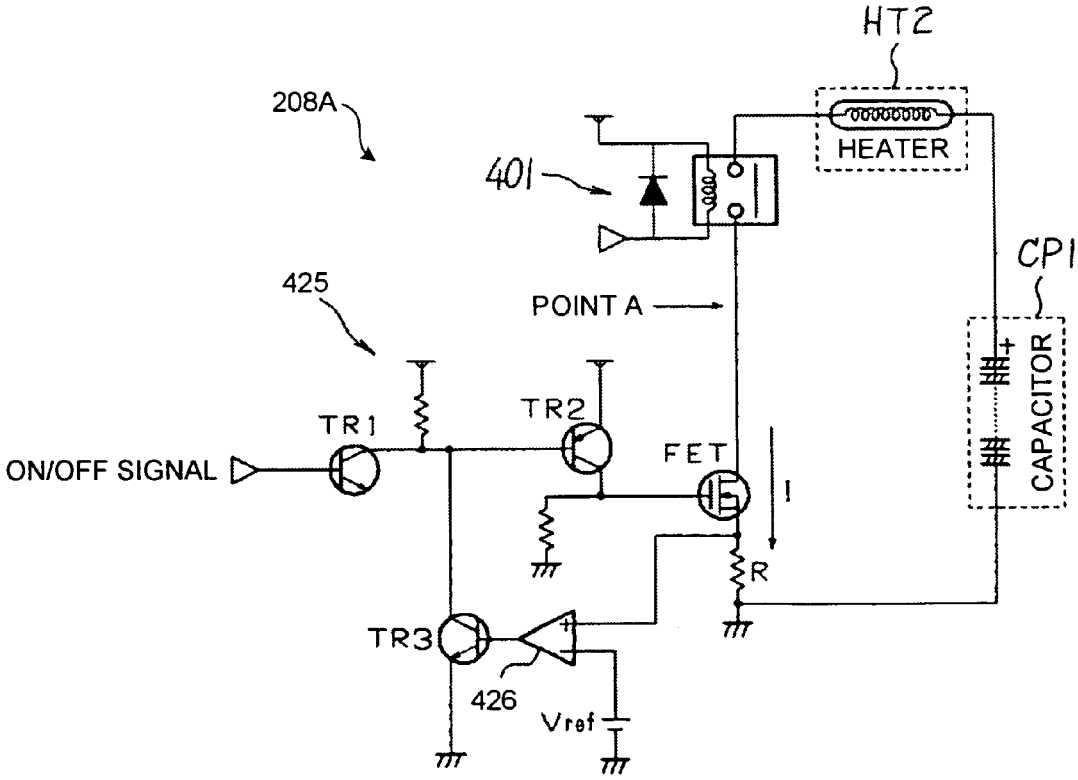
FIG. 9 is a circuit diagram for explaining a first example according to a second embodiment of the present invention.

FIG. 9 is a diagram of a capacitor charge-discharge circuit 208A according to a first example of the second embodiment. The capacitor charge-discharge circuit 208A includes the relay 401 as well as the semiconductor switch FET such as MOSFET, that cause the capacitor CP1 to supply power, or not to supply power to the fixing heater HT2. The on-signal and the off-signal for turning on/off the semiconductor switch FET are output from the microcomputer 411 of the controller 202, and input to the semiconductor switch FET through transistors TR1 and TR2 of a drive circuit 425. Between the source of the semiconductor switch FET and the ground, a resistor R for measuring the magnitude of current passing through the fixing heater HT2 is arranged. The voltage magnitude of the resistor R is input to a non-reverse input terminal of a comparator 426 where the magnitude is compared with a predetermined reference value Vref. And when the magnitude is higher than the reference value Vref due to an inrush current passing through the fixing heater HT2, the comparator 426 and a transistor TR3 output an on-signal to cancel the off-signal output by the microcomputer 411 (the microcomputer 411 can output the off-signal to the semiconductor switch FET when the inrush current is generated, because it outputs the off-signal based on only the temperature of the fixing roller 301 measured by the temperature sensor TH11).

Figure 10:
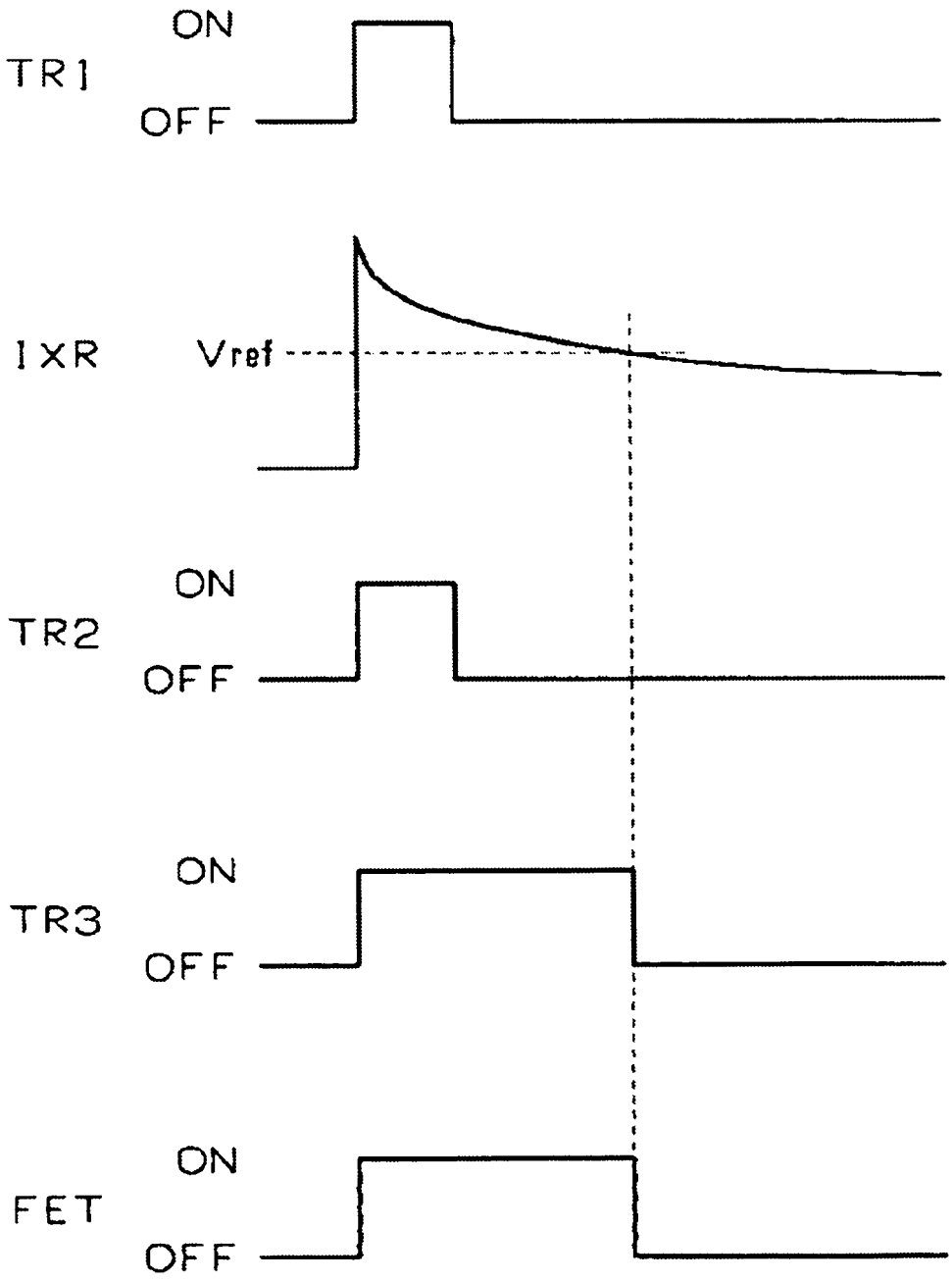
FIG. 10 is a timing chart for explaining status of each element shown in FIG. 9.

FIG. 10 is a timing chart for explaining status of each element shown in FIG. 9. The on-signal is output from the microcomputer 411 to turn on the transistors TR1 and TR2 and the semiconductor switch FET, thereby a current I passes through the fixing heater HT2. If the voltage of the resistor R (I×R) exceeds the reference value Vref, in other words, if an inrush current is generated, the transistor TR3 is turned on and cancels the off-signal even if the off-signal is output from the microcomputer 411. Therefore, while the voltage of the resistor R is higher than the reference-value Vref, the semiconductor switch FET keeps to be turned on and power supply from the capacitor CP1 to the fixing heater HT2 is continued, which prevents occurrence of counter-electromotive voltage.

Thus, when the semiconductor switch FET is turned on, the off-signal for turning off the semiconductor switch FET is canceled for a time required to prevent a counter-electromotive voltage due to the inrush current passing through the fixing heater HT2. As a result, it is possible to prevent voltage breakdown of the circuit due to the counter-electromotive voltage.

Figure 11A:
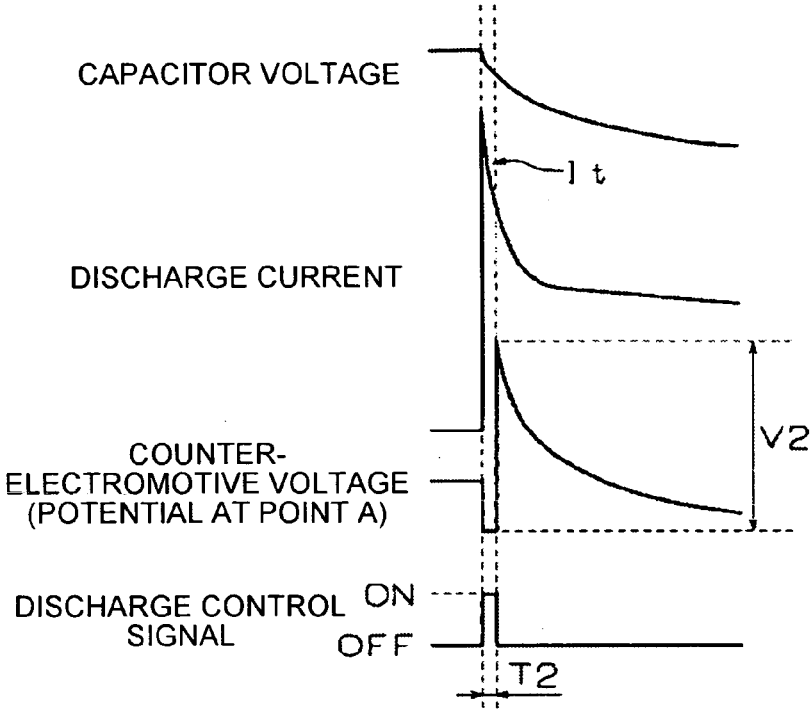
FIG. 11A and FIG. 11B are timing charts for explaining a difference in the counter-electromotive voltage according to the timing of turning off a switch.

FIG. 11A is a timing chart of a case in which power supply to the fixing heater HT2 is stopped while the inrush current being still large. As the voltage of the capacitor CP1 decreases by starting discharge, an inrush current It is generated according to the discharge current. At this time, if the microcomputer 411 outputs the on-signal to turn on the semiconductor switch FET for an extremely short time T2 and outputs the off-signal to turn off the semiconductor switch FET immediately thereafter, the voltage at a point A shown in FIG. 9 is as much as V2 (in other words, the counter-electromotive voltage occurs).

Figure 11B:
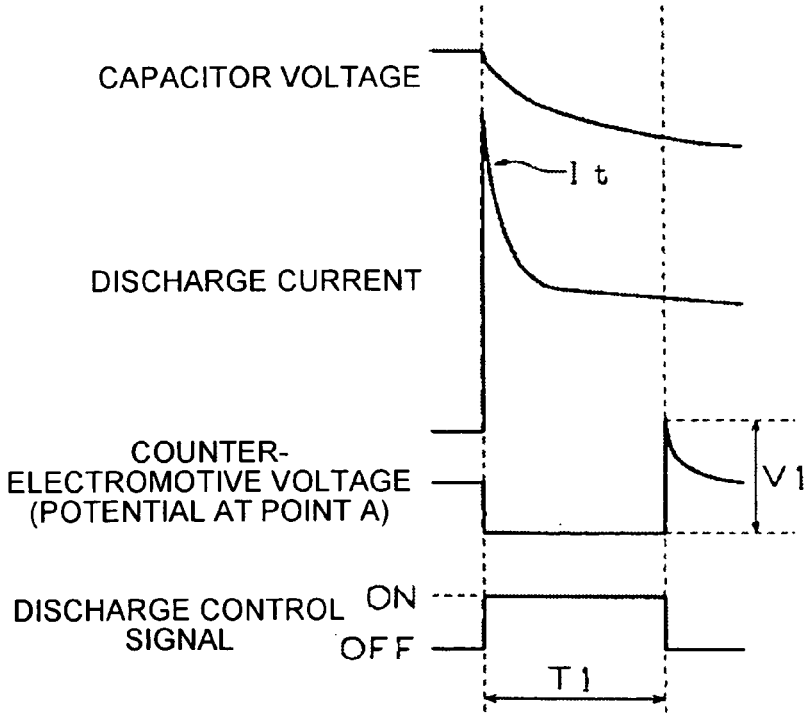

On the other hand, FIG. 11B is a timing chart of a case in which power supply to the fixing heater HT2 is stopped after the inrush current becomes small. As the voltage of the capacitor CP1 decreases by starting discharge, an inrush current It is generated according to the discharge current. At this time, if the off-signal output from the microcomputer 411 is canceled by the on-signal from the comparator 426 for a time T1 required to prevent the counter-electromotive voltage, the voltage at the point A is decreased to V1.

Figure 12:
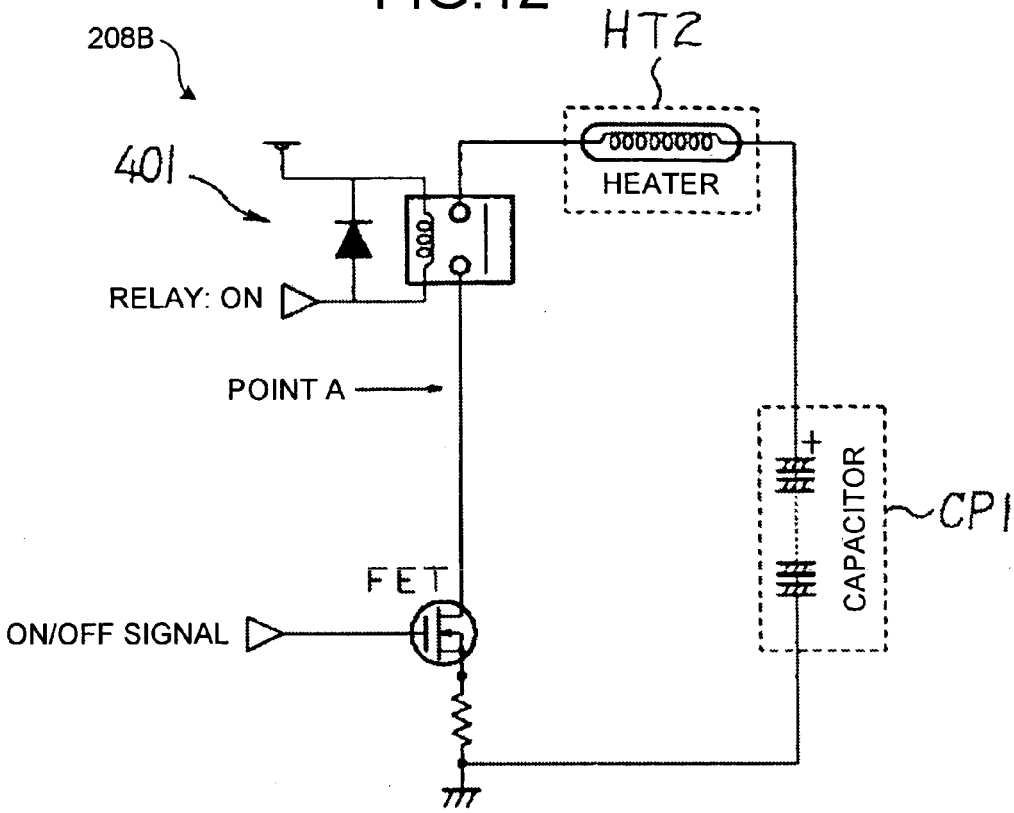
FIG. 12 is a circuit diagram for explaining a second example according to the second embodiment.
Figure 13:
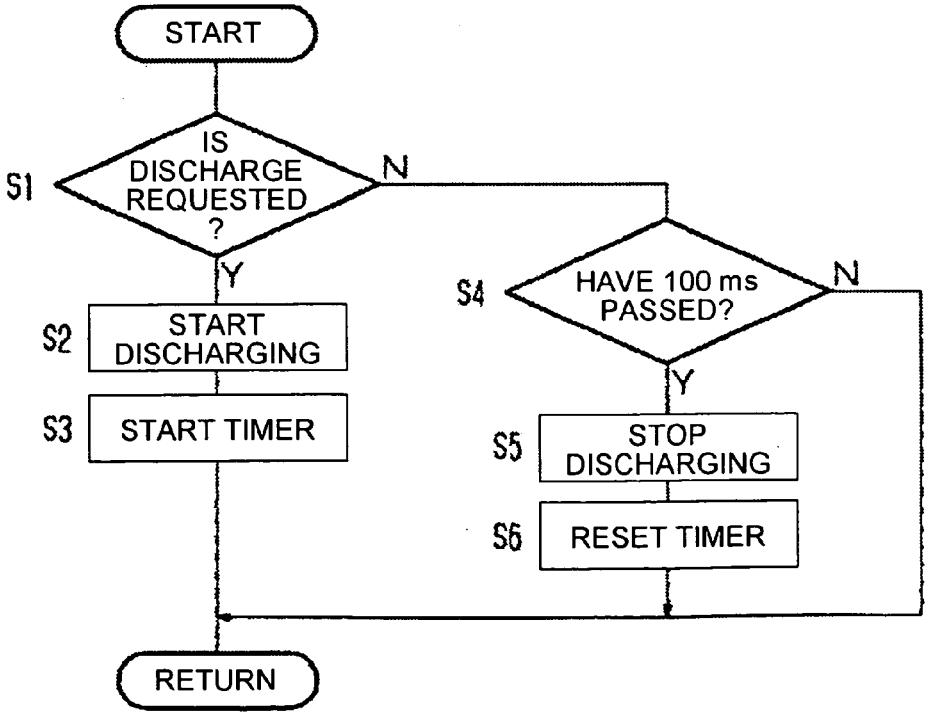
FIG. 13 is a flowchart of processes to be executed by a microcomputer of the second example.

FIG. 12 is a circuit diagram of a capacitor charge-discharge circuit 208B according to a second example of the second embodiment. The circuit elements having the same reference signs as those of FIG. 9 have the same functions explained above, and therefore, detailed explanation thereof is omitted. The circuit shown in FIG. 12 is different from the circuit shown in FIG. 9 in that the drive circuit 425 is not provided and the on-signal and the off-signal are input to the semiconductor switch FET directly from the microcomputer 411 of the controller 202, which executes the processes shown in FIG. 13. More specifically, if discharge of the capacitor CP1 is requested (step S1: Yes), the microcomputer 411 of the controller 202 causes the capacitor CP1 to start supplying power to the fixing heater HT2 by outputting the on-signal to the semiconductor switch FET (step S2). At the same time, the microcomputer 411 starts a timer (step S3). Thereafter, when the time counted by the timer reaches the time T1 for preventing the counter-electromotive voltage (see FIG. 11B) (step S4: Yes), 100 milliseconds for example, the microcomputer 411 causes the capacitor CP1 to stop supplying power to the fixing heater HT2 by outputting the off-signal to the semiconductor switch FET (step S5). Then, the timer is reset (step S6).

In the example shown in FIG. 9, whether the counter-electromotive voltage is occurring or not is determined by actually measuring the voltage. On the other hand, in the example shown in FIG. 12, the counter-electromotive voltage is assumed to occur during a preset time T1 after the output of the on-signal is started. And the transistor TR 2 keeps outputting on-signal during the time T1, without outputting the off-signal. In both the configuration shown in FIG. 9 and FIG. 12, the semiconductor switch FET is maintained to be on while it is necessary to prevent a counter-electromotive voltage after it is turned on, even if the discharge of the capacitor CP1 is not requested, thereby occurrence of the counter-electromotive voltage is prevented.

However, the configuration shown in FIG. 9 is more reliable than the configuration shown in FIG. 12, because the semiconductor switch FET is certainly maintained to be on during the inrush current is generated. On the other hand, the configuration shown in FIG. 12 does not need the drive circuit 425 shown in FIG. 9, which makes the circuit configuration simpler and manufacturing costs less expensive.

According to one aspect of the present invention, turning on and off a power supply from the capacitor to the fixing heater can be carried out by a semiconductor switch as well as a mechanical switch. Thus, it is possible to improve the safety of the circuit.

According to another aspect of the present invention, when the switch is turned on, the switch is maintained to be on for a time required to prevent counter-electromotive voltage caused by the inrush current passing through the fixing heater due to turning on of the switch. It is thereby possible to prevent occurrence of counter-electromotive voltage, and voltage breakdown to the circuit.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing device that fixes a toner image to a recording medium by applying heat and pressure, comprising:

a heating unit that generates the heat;

a capacitor that supplies power to the heating unit;

a first switching unit that causes the capacitor to supply the power to the heating unit;

a second switching unit that is connected in series with the heating unit, the capacitor and the first switching unit, the second switching unit switching on and off faster than the first switching unit; and a power controlling unit that turns on and off the second switching unit and the first switching unit responsive to a signal from an interlock switch, wherein the power controlling unit turns off the second switching unit prior to turning off the first switching unit, and turns on the first switching unit prior to turning on the second switching unit.

2. The fixing device according to claim 1, wherein the first switching unit is a mechanical switch including a relay, and the second switching unit is a semiconductor switch including a metal oxide semiconductor field-effect transistor (MOSFET).

3. The fixing device according to claim 1, further comprising:

a power controlling unit that turns on both the first switching unit and the second switching unit to cause the capacitor to supply the power to the heating unit, and turns off both the first switching unit and the second switching unit to cause the capacitor to stop supplying the power to the heating unit.

4. An image forming apparatus that uses electrophotographic method to fix a toner image to a recording medium by applying heat and pressure, comprising:

a heating unit that generates the heat;

a capacitor that supplies power to the heating unit;

a first switching unit that causes the capacitor to supply the power to the heating unit;

a second switching unit that is connected in series with the heating unit, the capacitor and the first switching unit, the second switching unit switching on and off faster than the first switching unit; and a power controlling unit that turns on and off the second switching unit and the first switching unit responsive to a signal from an interlock switch, wherein the power controlling unit turns off the second switching unit prior to turning off the first switching unit, and turns on the first switching unit prior to turning on the second switching unit.

5. A heating device comprising:

a heating unit that generates heat;

a capacitor that supplies power to the heating unit;

a first switching unit that causes the capacitor to supply the power to the heating unit;

a second switching unit that is connected in series with the heating unit, the capacitor and the first switching unit, the second switching unit switching on and off faster than the first switching unit; and a power controlling unit that turns on the first switching unit and the second switching unit, wherein the power controlling unit keeps the first switching unit and the second switching unit turned on for a time required to prevent a counter-electromotive voltage due to an inrush current.

6. The heating device according to claim 5, further comprising a current detecting unit that detect magnitude of the inrush current, wherein the power controlling unit keeps the first switching unit and the second switching unit turned on for a time during which the inrush current detected by the current detecting unit is higher than a predetermined value.

7. The heating device according to claim 5, wherein the power controlling unit keeps the first switching unit and the second switching unit turned on for a preset time.

8. A fixing device that fixes a toner image to a recording medium by applying heat and pressure, comprising:

a heating unit that generates the heat;

a capacitor that supplies power to the heating unit;

a first switch that causes the capacitor to supply the power to the heating unit;

a second switching unit that is connected in series with the heating unit, the capacitor and the first switching unit, the second switching unit switching on and off faster than the first switching unit; and a power controlling unit that turns off the first switching unit and the second switching unit, wherein the power controlling unit keeps the first switching unit and the second switching unit turned on for a time required to prevent a counter-electromotive voltage due to an inrush current.

9. The fixing device according to claim 8, further comprising a current detecting unit that detect magnitude of the inrush current, wherein the power controlling unit keeps the first switching unit and the second switching unit turned on for a time during which the inrush current detected by the current detecting unit is higher than a predetermined value.

10. The fixing device according to claim 8, wherein the power controlling unit keeps the first switching unit and the second switching unit turned on for a preset time.

11. An image forming apparatus that uses electrophotographic method to fix a toner image to a recording medium by applying heat and pressure, comprising:

a heating unit that generates the heat;

a capacitor that supplies power to the heating unit;

a first switching unit that causes the capacitor to supply the power to the heating unit;

a second switching unit that is connected in series with the heating unit, the capacitor and the first switching unit, the second switching unit switching on and off faster than the first switching unit; and a power controlling unit that turns on the first switch and the second switching unit, wherein the power controlling unit keeps the first switching unit and the second switching unit turned on for a time required to prevent a counter-electromotive voltage due to an inrush current.

* * * * *